United States Patent [19]

Muri

[11] 4,440,806

[45] Apr. 3, 1984

[54] RAINFALL SANDER

[75] Inventor: Georges Muri, Mount Royal, Canada

[73] Assignee: Shell-O-Matic Inc., Montreal, Canada

[21] Appl. No.: 397,908

[22] Filed: Jul. 13, 1982

[51] Int. Cl.[3] ..... B05D 1/02

[52] U.S. Cl. ..... 427/180; 239/687; 239/688; 414/301; 118/308; 118/312; 118/DIG. 16

[58] Field of Search ..... 239/687, 688; 414/301; 118/308, 312, DIG. 16; 427/180

[56] References Cited

U.S. PATENT DOCUMENTS

| | | | |
|---|---|---|---|
| 1,065,960 | 7/1913 | Murray | 239/688 |
| 2,573,835 | 11/1951 | Dyar | 118/308 X |
| 2,692,702 | 10/1954 | Church | 414/301 X |
| 3,780,887 | 12/1973 | Bottoms | 239/688 X |
| 4,265,296 | 5/1981 | Ostrowski | 118/312 X |
| 4,277,205 | 7/1981 | Meunier | 414/301 X |
| 4,371,568 | 2/1983 | von Tell | 118/312 X |

*Primary Examiner*—Shrive P. Beck

*Attorney, Agent, or Firm*—McFadden Fincham & Co.

[57] ABSTRACT

This invention provides a distribution system suitable for coating articles placed in a given area with particulate material in a substantially uniform manner. The system comprises a plurality of arms which are provided with an inlet opening and a discharge opening. The arms are mounted for rotation about a central axis in conjunction with means for dividing and feeding a supply of particulate material from a source thereof into said inlet openings of the arms. The discharge opening is located on each of the arms in such manner so as to permit discharge of the particulate material from each arm over the given area, whereby when the arms rotate in conjunction with the dividing and feeding means, a supply of particulate material is divided and fed into the inlet openings of the arms and is discharged through the discharge opening. In this manner, a substantially uniform shower of the particulate material is provided over the given area.

10 Claims, 4 Drawing Figures

RAINFALL SANDER

This invention relates to an apparatus for distributing particulate matter over, e.g., wax investment molds which are used in the investment casting art.

In the investment casting art, various processes are used for forming wax patterns of material to be reproduced in a metal form. Reference may be had to the literature for the general background involving the investment casting art, but in summary, this requires that the investment casting patterns be faithfully reproduced to achieve a high degree of precision. One step in the investment casting art using the lost wax type of process involves the formation of wax patterns by injecting wax into metal cavities which have the shape of the part desired to be formed in metal. Thereafter, the wax patterns are molded, typically on a sprue or tree using runners which serve the function of forming channels for the molten metal to flow into the areas previously occupied by the wax patterns (and the wax runners or sprues) when the wax has been melted or otherwise removed from the coated mold.

The coating of the material onto the wax pattern mold is a critical step in the formation of the process since the wax patterns, although possessing a fair degree of strength, are still fragile and must be handled with care. In the shell mold type of coating applied to wax patterns, one or more initial treatments of various types of material are applied to the wax set-up and which treatments include the application of particulate matter such as particulate refractory material, onto the wax set-up, normally after the latter has been dipped in a slurry to permit the refractory material to adhere to the wax set-up.

In the past, all technique for the formation of shell molds has included the use of fluidized beds of refractory material into which the wax set-up is placed (after being wetted) and the sand, in a fluidized manner, is supposed to adhere to the wetted wax set-up. This type of fluidized bed operation tends to be somewhat hard on the wax set-up since it will sometimes break or deform the fragile wax patterns. In addition, the fluidized bed coating process does not otherwise provide a uniform coating on all of the wax patterns.

Other attempts to provide refractory material coatings have involved the application of refractory material by spraying the refractory material with a nozzle onto the wetted wax set-up, but again, undue force may cause imperfections on the wax patterns and accordingly, no attempt has been made to the applicant's knowledge, to apply this type of process to any extent, particularly in large scale commercial operations and where wax patterns cannot be subjected to any degree of force.

With this invention, applicant has developed an apparatus and method for coating wax patterns with particulate material which overcomes the disadvantages associated with the coating of wax patterns as mentioned above and which provides a wax pattern substantially free of deformations or imperfections caused from undue force, while attaining a uniform and even coating of particulate material on the wax set-up.

In accordance with one embodiment of this invention, there is provided a distribution system suitable for coating articles placed in a given area with particulate material in a substantially uniform manner, the distribution system comprising a plurality of arms, said arms being provided with an inlet opening and a discharge opening, said arms being mounted for rotation about a central axis in conjunction with means for dividing and feeding a supply of particulate material from a source thereof into said inlet openings of the arms, the discharge opening being located on each of the arms in such a manner so as to permit discharge of the particulate material from each arm over the given area, whereby when the arms rotate, and in conjunction with the dividing and feeding means, a supply of particulate material is divided and fed into the inlet openings of the arms and is discharge through the discharge opening, thereby providing a substantially uniform shower of the particulate material over the given area.

In accordance with a further embodiment of the invention, an apparatus is provided for coating articles with particulate material, the apparatus comprising first retaining means for retaining a supply of particulate material; supply means for supplying a flow of particulate material from the first retaining means to second retaining means; distribution means for distributing a supply of particulate material from the second retaining means in the form of a shower of the particulate material dispersed in a substantially uniform flow over a given area; the first retaining means being located beneath the distribution means, whereby the flow of particulate material from the distribution means is gathered by the first retaining means.

In a preferred embodiment of the invention, there is provided an apparatus for coating articles with particulate material comprising first retaining means for retaining a supply of particulate material; supply means for supplying a flow of particulate material from the first retaining means to second retaining means; the first retaining means being detachably secured to the supply means; distribution means comprising a conical member movable between an open and a closed relationship with the second retaining means and comprising a plurality of arms extending therefrom; each arm being provided with an inlet opening adjacent the conical member and a discharge opening on the underside thereof to permit the flow of particulate material therethrough; a shaft extending through the second retaining means and being secured to the conical member, the shaft being movable in a vertical direction to provide the open or closed relationship with the second retaining means and the shaft further being rotatable; whereby when the conical member is in an open relationship with the second retaining means, a flow of particulate material is provided from the second retaining means into the distribution means, and rotation of the shaft provides a uniform flow of the particulate material over a given area.

In still a further embodiment of the present invention, there is provided a method of coating an article with particulate material which comprises providing an article to be coated with a finely divided particulate material, providing a supply of finely divided particulate material, placing said article in downstream relationship to the supply of particulate material, forming a first stream of the particulate material from the supply thereof and dividing the stream into a plurality of smaller streams which are radially dispersed relative to the axial flow direction of the first stream to thereby form a shower of the particulate material dispsersed in a substantially uniform flow of the particulate material over a given area downstream of the supply thereof, whereby a substantially uniform coating is provided on the article.

In a preferred method of the present invention, a method is provided which comprises providing a disposable wax pattern, providing a supply of finely divided particulate material in a first retaining means adapted to coat the wax pattern, dividing the supply of particulate material into a plurality of radial streams thereof, causing the streams to rotate about a fixed vertical axis with each of the streams projecting a varying length outwardly from the axis, disposing the streams while rotating about the axis to form a shower of the particulate material over a given area, placing the article to be coated downstream of the shower of particulate material in the given area, and coating the article with the particulate material.

Preferably, the distribution means of the present invention comprises a conical member with a plurality of hollow arms extending outwardly therefrom. In its most preferred form, the arms of the distribution means are constructed of varying lengths relative to each other so that a uniform shower of particulate material is spread over the desired given area.

In addition to the arms discussed above, the distribution means may also be provided with a baffle plate mounted so as to deflect or divert particulate material from the second retaining means over the central core of the given area where an article to be coated is placed. Such a baffle plate may also be provided with one or more apertures along the length thereof so as to ensure a more uniform distribution of the particulate material.

The arms of the distribution means may also be provided with means such as a baffle plate adjacent the discharge openings of the arms so as to deflect particulate material passing into the arms out through the discharge openings. In addition, if the discharge openings of the arms are located at the ends of the arms remote from the axis about which they rotate, and in view of the varying lengths of the arms, a more uniform shower of the particulate material is provided over substantially all of the given area downstream of the flow so that an article to be coated with the particulate material would be evenly and uniformly coated therewith.

The specific type of material which may be employed as particulate material is well known to those skilled in the art and as such, includes, various types of sands of varying densities.

In preferred embodiments, it has been found that a plurality of arms e.g. 10 to 20 arms (inclusive of a baffle plate to divert particulate material to the central core of the given area) provides a desirably uniform shower of particulate material. It will be appreciated, however, that the number of arms required could be increased or decreased depending on any given article to be coated and the size of the apparatus. Likewise, the range of lengths of the arms will be dictated by the dimensions of the article to be coated in any given situation. Thus, for the coating of a small wax pattern, for example, the length of the longest arm need not be as great as would be required for a larger wax pattern, and the number of arms needed to obtain a uniform coating in the case of a small wax pattern may also be limited to a lesser number than otherwise would be necessary for a larger article to be uniformly coated.

Having thus generally described the invention, reference will now be made to the accompanying drawings illustrating preferred embodiments, in which.

Figure 1:
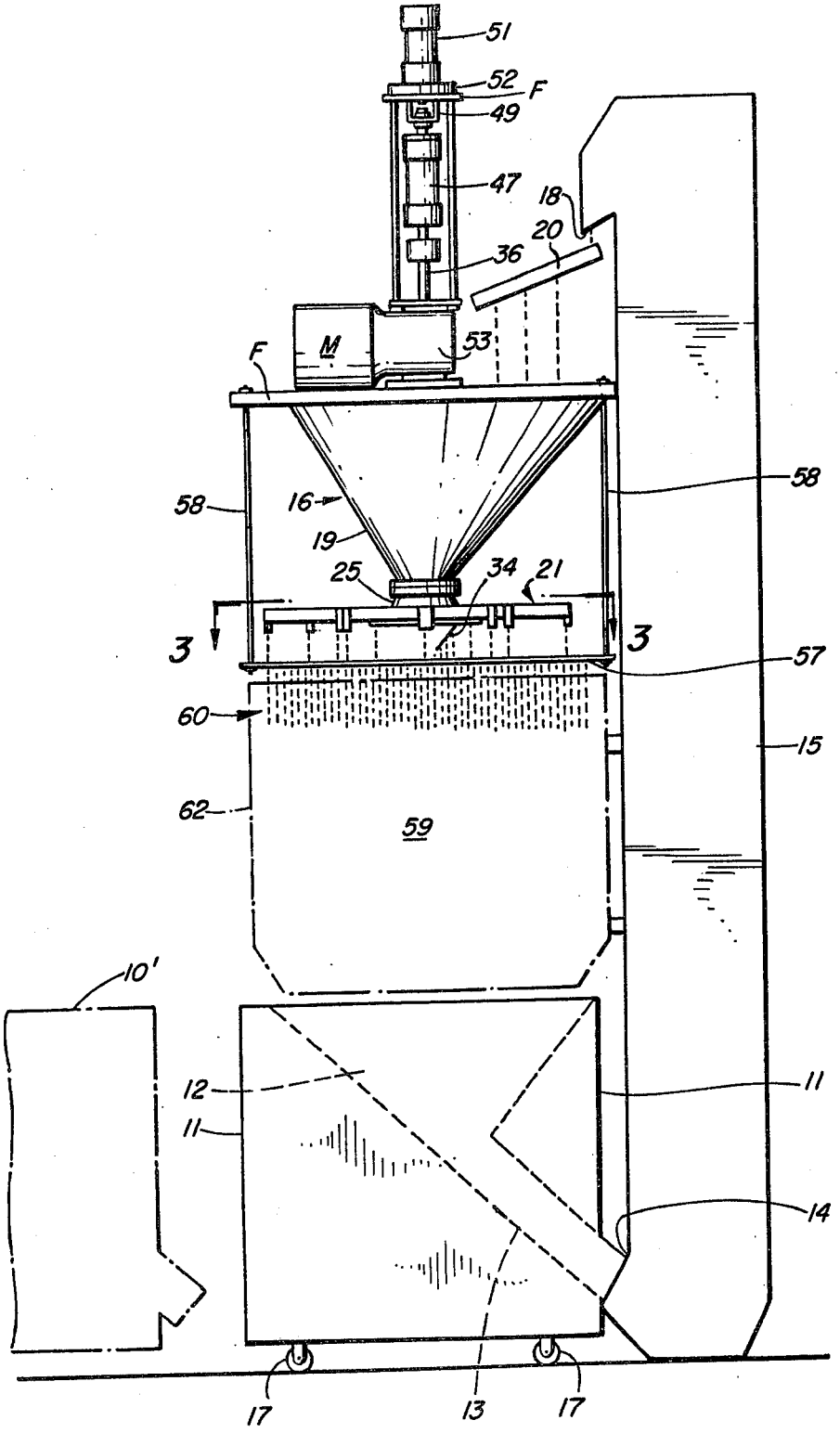
FIG. 1 is a side elevational view of the apparatus of the present invention.

The apparatus of the present invention is shown generally in FIG. 1. As will be seen from FIG. 1, a first retaining and receiving bin 10 is provided which both retains a supply of particulate material (e.g., sand), and which gathers the particulate material as will be discussed in great detail hereinafter.

As shown in FIG. 1, in greater detail, the retaining bin 10 comprises a walled enclosure defined by walls 11 which house a tapered funnel-shaped collecting means 12. The mouth of the collecting means 12 comprises an open top and will be seen to be generally of a width corresponding to the width of the apparatus of the present invention so as to gather all of the particulate material as the latter falls downwardly. The funnel-shaped collecting means 12 includes at its lowermost end a discharge conduit 13 terminating in a discharge outlet 14 which connects to means 15 for carrying a supply of particulate material as explained hereinafter.

The retaining bin 10 is detachably secured to the means 15 for carrying a supply of particulate material from the bin 10 for discharge into a second retaining means 16. The retaining bin 10 may be secured to the supply means 15 by any suitable means, e.g., by pins, which will provide for easy connection and disconnection of the bin 10 from the means 15. As will be seen from FIG. 1, the bin 10 can be easily removed and another bin 10' rolled in and connected up to the means 15. Rollers or wheels 17 can be provided on the retaining bin 10 to permit easy removal of one bin 10 and replacement with another bin 10'. Thus, when a new supply or a different type of particulate material is required, the bin 10 can merely be detached from the supply means 15, and a new bin 10' containing a supply of particulate material rolled in and coupled to the supply means 15.

By virtue of the configuration of the collecting means 12 and the discharge conduit 13, particulate material contained in the bin 10 is free to flow from the bin through the discharge conduit 13 and be discharged via outlet 14 into the supply means 15. The supply means 15 for transferring the particulate material from the first bin 10 to the second retaining means 16 may be in the form of a bucket elevator or any other suitable recess. The configuration of bucket elevators per se is well known to those skilled in the art and thus, any suitable arrangement for this purpose may be employed. Alternatively, other arrangements for transferring the particulate material from the bin 10 may be employed such as a fluidizing apparatus operating in conjunction with suction means, etc.

When a new supply of particulate material is required by the second retaining means 16, the bucket elevator 15 is activated and carried such new supply of particulate material to the retaining means 16.

In the embodiment illustrated in FIG. 1, the bucket elevator 15 includes a discharge port 18 for discharging the particulate material into the second retaining bin 16.

The retaining means 16, in the embodiment illustrated, comprises a second bin generally in the form of a tapering conical container defined by tapering walls 19 and having an open mouth for receiving the particulate material discharged from the discharge port 18. As will be seen from the drawings, the bin 16 is placed in operative relationship to the discharge port 18 of the bucket elevator 15. Interposed at the point where the particulate material is discharged from the discharge port 18 is a screen 20 which is an optional component of the apparatus. Screen 20 may be provided, if desired, to separate out any oversized material, which is then removed from the screen in any suitable manner. Also, if desired, a vibrator (not shown) could also be provided to cause vibration of screen 20 to facilitate the separation of larger-sized particles from the particulate material. As will be seen, the particulate material falls through the screen 20 and into the bin 16.

The bin 16 includes a plate member 40 (FIG. 4) having a sealing member 41 secured thereto by means of bolt 42. The sealing member 41 provides for a closure between the second retaining bin 16 and the conical member 26 as discussed hereinafter.

Figure 3:
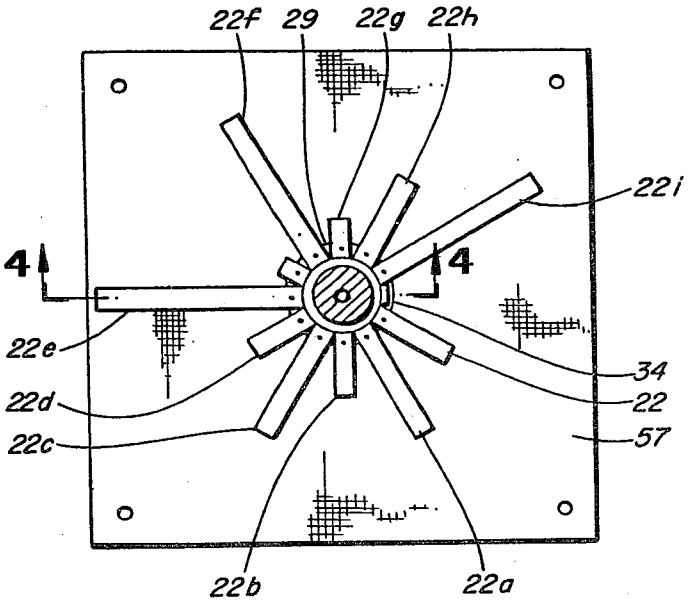
FIG. 3 is a view taken along the line 3—3 of FIG. 1.
Figure 4:
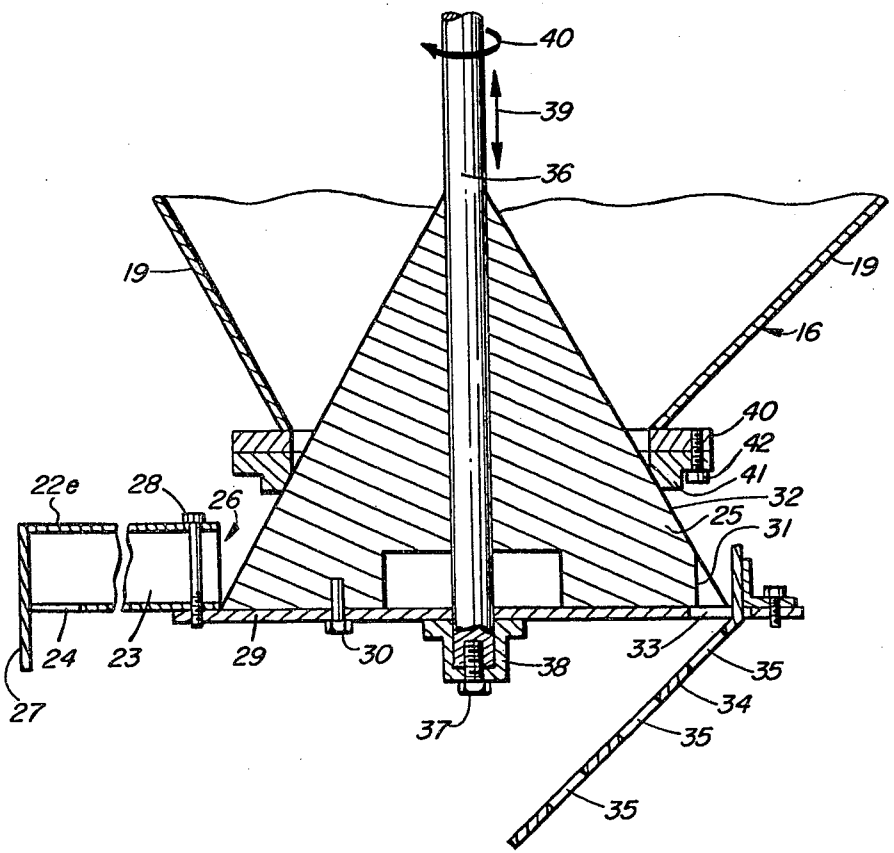
FIG. 4 is a view taken along the line 4—4 of FIG. 3.

Referring to FIGS. 1, 3 and 4 in greater detail, there is illustrated the distribution means for distributing particulate material from the bin 16 in the form of a shower of the particulate material over a given area. More particularly, the distribution or spreader means is indicated generally by reference numeral 21 in FIG. 1. As will be seen from FIGS. 3 and 4, the spreader means comprises a plurality of arms 22 through **22*i*. In the embodiment illustrated and in a preferred form of the invention, the arms 22 through 22*i* are preferably of varying lengths relative to one another. Each arm 22 through 22*i* comprises a hollow chamber 23 (FIG. 4) with all arms being generally constructed in a similar manner and with the particulate material being adapted to flow from a central axial portion of each arm through the arm to a discharge opening 24 as discussed hereinafter. As will be noted from FIG. 3, the arms 22 to 22*i* with their varying lengths, are adapted to provide coverage over a given area directly thereunder and hence the reason for the arms having varying lengths. The arms 22 to 22*i* terminate adjacent a conical member 25 which is adapted to distribute the supply of particulate material to the individual arms from the bin 16. To this end, each of the arms 22 to 22*i* has an inlet opening at its axially located end as indicated by reference numeral 26 and has a discharge opening 24 which, in the embodiment shown, is located on the underneath side of the arms. Preferably, each arm has a baffle plate 27 extending beneath the discharge opening 24** to project the discharged particulate material in a downward direction.

FIG. 4 illustrates the discharge opening 24 of each arm as being at the end of the arms remote from the central axis thereof, however, it will be appreciated that the discharge opening could be located at other points along the length of the arms.

Referring now to the conical member 25 in greater detail, as will be seen from FIG. 4, the arms 22 through **22*i* are mounted, for example, by means of bolt 28 to plate member 29. Plate member 29 in turn has mounted thereon the conical member 25 by means of bolt 30. The arms 22 through 22*i* are mounted to the plate member 29 adjacent the conical member 25. One side of the conical member 25 may be provided with a vertical wall 31 whereby particulate material dispersed over the surface 32 of the conical member 26 can freely fall downwards through an aperture 33 in plate member 29, whereupon the particulate material is deflected by baffle plate 34 having one or more apertures 35 therein. Thus, the provision of baffle plate 34 and vertical wall 31 of the conical member 25** functions to permit particulate material to be dispersed in the central core of the given area thereunder.

Conical member 25 includes a vertical shaft or rod 36 extending through the center thereof and continuing up through the open top of the retaining bin 16. At its lowermost end, shaft 36 is fixed to plate 29 via bolt 37 and bracket 38. Shaft 36 is rotatable about a central axis and is movable in a vertical direction. Thus, shaft 36 controls the movement of conical member 25 in the direction of the arrows 39 and 40 indicated in FIG. 4. This will also be seen to control the movement of the arms 22 through **22*i* as well as the plate 29. In the position shown in FIG. 4, the conical member 25 is in a closed relationship with respect to the retaining means 16 whereby any particulate material in the retaining means 16 is held therein. When the shaft 36 is lowered from the position shown in FIG. 4, by virtue of the configuration of the conical member 25 relative to the retaining means 16, an open relationship is defined between the conical member 25 and the retaining means 16, whereby a flow of particulate material is free to run from the retaining means 16 over the surface 32 of conical member 25, and is divided and fed by the conical member 25 into the arms 22 through 22*i***.

If desired, a further screen 57 may be provided, suspended from Frame F by posts 58. Such a screen would serve to further strain the particulate material as it passes therethrough and also aids in the uniform distribution of the particulate material over the given area.

Figure 2:
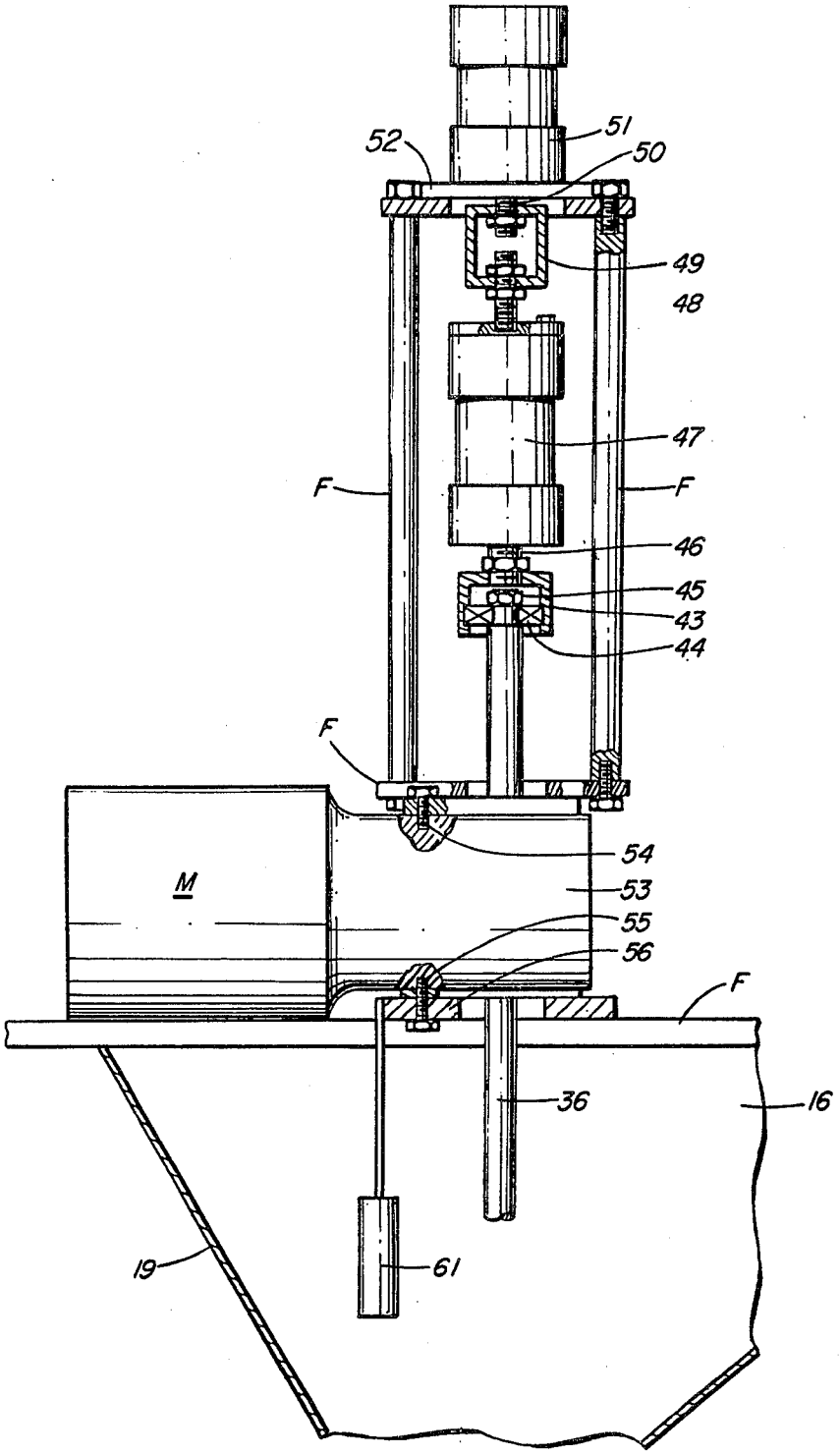
FIG. 2 is an exploded view showing the pneumatic system of the present invention.

Referring now to FIG. 2, the shaft 36 and its associated components are illustrated in a preferred form. As will be seen, shaft 36 extends through the open top of the retaining bin 16 and terminates in a housing 43. The shaft 36 is secured to a collar 44 via nut 45, and the collar in turn is secured to housing 43. As previously mentioned, the shaft 36 is rotatable, and to this end, a rotary union is provided in the housing 43. Housing 43 is further connected to piston rod 46 of piston cylinder 47 by suitable means. Piston cylinder 47 is provided with a shaft 48 which is connected to a further housing 49 by any suitable means. Housing 49 has piston rod 50 mounted therein and piston cylinder 51 is fixedly mounted on plate 52 which in turn mounts frame member F.

Motor M shown in FIG. 2 is provided to engage the shaft 36 in its rotational motion. To this end, motor M has shaft 53 mounted to shaft 36. Motor M is further fixed by means of bolt 54 to frame member F and by means of bolt 55 to busing 56 which in turn is mounted on frame F.

It will be appreciated that although two piston cylinders are shown in the apparatus of FIG. 2, the apparatus of the present invention could also be operated with the use of one piston cylinder. The double cylinder arrangement illustrated is merely a preferred arrangement in order to obtain more precision as to the amount of particulate material allowed to flow from the bin 16. Thus, the provision of a double arrangement allows for the precise control of the size of the opening between the bin 16 and the conical member 25.

In addition, it would be pointed out that although the apparatus is described in connection with the use of pneumatic means, other suitable means, e.g., hydraulic means, may be employed in the alternative.

In operation, an article to be coated (e.g., a wax pattern) with particulate material, having first been dipped in a slurry to permit the particulate material to adhere thereto, is brought into the area 59 shown in FIG. 1. The wax pattern may be held in this area by suitable means known to those skilled in the art, and such means may include provision for turning the wax pattern through a series of motions so as to ensure the total mold is thoroughly coated with the desired material. Particulate material, such as sand, is carried from the bin 10 via the bucket elevator 15 and is discharged via outlet port 18 into the retaining means 16. The sand may, if desired, first be strained through a sand cleaner or screen 20 (FIG. 10 so as to separate out any larger particles of sand since the sand may have been used in a previous operation. In addition, the screen 20 may be vibrated by means of a vibrator (not shown) in order to facilitate the separation of the larger particles. It will be appreciated that if the retaining bin 16 already contains a supply of particulate material from a previous operation sufficient to coat the wax pattern, then the bucket elevator need not carry a new supply.

Once the wax pattern is in position in area 59, the shaft 36 is activated, thereby opening up a flow of sand from the bin 16 over the surface 32 of the conical member 25. Depending on whether a heavy flow or a smaller flow of sand is required for coating the wax pattern, either one of both of the pneumatic cylinders 47 and 51 are activated to move the shaft downwardly, thus opening up a space between the surface 32 of the conical member 25 and the sealing member 41 of the retaining bin 16. If a small flow of the particulate material is desired, only pneumatic cylinder 47 need be activated, piston rod 46 causing the shaft 36 to move downwardly by means of housing 43. If a heavier flow is required, cylinder 51 is activated and piston rod 50 which is connected to housing 49 moves the shaft 48 and its associated cylinder 47 downwardly. Cylinder 47, then in a lower position, is activated and piston rod 46 moves shaft 36 downwardly by means of housing 43. Since the cylinder 47 was moved to a lower position, the opening provided between the bin 16 and conical member 26 is wider and allows a larger supply of particulate material to pass therethrough.

It should be noted that cylinder 47 could be utilized alone to provide different sizes of openings for the passage of particulate material merely by having the piston rod 46 move by the desired degree, however, it has been found that better precision is attained with the use of two cylinders to provide the desired degree of opening, and thus controlling the amount of particulate material distributed over the wax pattern.

The activation of motor M starts up the rotation of shaft 36 and in turn, plate 29, conical member 25 and arms 22 through **22*i*. Thus, the spinning motion of the conical member 25 serves to divide up the flow of particulate material from the bin 16, passing over the surface 32 of the conical member, and feeds the flow of sand into inlet openings 26 of arms 22 through 22*i*. By virtue of the spinning motion of the conical member 25 and the arms, particulate material passes through inlet openings 26 of arms 22 through 22*i*, through the arms, and falls through discharge openings 24 provided in the arms. Baffle plates 27 serve to retain the rainfall of sand within the desired area and the spinning of the arm arrangements provides a rainfall dispersal of sand over the area 59 occupied by the wax pattern. By also providing a deflector arm 34 provided with apertures 35, particulate material passing over surface 32 is directed by vertical wall 31 of conical member 25 through aperture 33 in plate 29 and is diverted by the deflector arm 34 towards the central core of the area 59**.

Thus, in view of the varying lengths of the arms, and their continued spinning motion, as well as with the provision of baffle plate 34, it will be seen that the area 59 is provided with an even and uniform shower or rainfall 60 of particulate material. Since the wax pattern held in area 59 is turned through a set of motions so that all faces of the pattern are directed to the shower of particulate material, the wax pattern is provided with a uniform coating of the particulate material and since the shower of particulate material is in the form of a fine and dense rainfall, no force is exerted on the fragile wax patterns, thereby providing a coated was pattern substantially free of deformations.

As will be seen from FIG. 1, a further screen 57 may also be provided to further strain the particulate material after leaving the arms. The screen 57 also permits a more even dispersal of the shower of sand over the wax pattern.

As will be appreciated, the novel spreader means of the present invention provides a dense and uniform shower of refractory material such as sand onto the wax pattern, and by virtue of the varying lengths of the arms, a completely and fully coated wax pattern is obtained. In addition, since no force is exerted on the wax pattern itself, such as is sometimes encountered in the fluidized bed type of process for coating such patterns, deformations and imperfections in the wax pattern are avoided. The novel spreader of the present invention, in addition to avoiding the above disadvantage, also provides a more uniform coating of the wax pattern than has previously been attainable with known methods and apparatus for coating such patterns.

As discussed above, if the retaining bin 16 contains sufficient particulate material for the coating of an article, the supply means 15 need not be activated to carry a further supply thereto. To this end, suitable means such as a level control 61 (FIG. 2) may be provided in the retaining bin 16 to provide indication of when a further supply of particulate material is required to be transferred by the supply means 15 from the bin 10 to the second retaining means 16 to carry out a further coating process of a wax pattern.

Also, if desired, a curtain assembly (FIG. 1) indicated by reference numeral 62 could also be provided to surround the wax pattern being coated during the coating process. Such an assembly could be in the form of doors which merely swing open and closed to allow for the entry and exit of a wax pattern, or could be an actual curttain assembly of a flexible material suspended on circular runners around the area 59, with provision being made for the opening and closing of the curtains as desired prior to and after the coating process.

It should also be noted that while the arrangement shown in the drawings and the preferred form of the apparatus employs a conical member for dividing and feeding the stream of particulate material into the arms, any other suitable means which functions to permit division of the particulate material flowing from the bin to the arms into a plurality of streams flowing into the individual arms may be employed.

It will be understood that various modifications can be made to the above without departing from the spirit and scope of the invention.

I claim:

1. A method of coating an article such as a wax pattern with particulate material which comprises providing an article to be coated with a finely divided particulate material, providing a supply of finely divided particulate material, placing said article in downstream relationship to said supply of particulate material, feeding said finely divided particulate material from said supply to form a first central stream of said particulate material, subjecting said stream to the action of a rotating conical flow-controlling member to form an annular stream, feeding said annular stream through a plurality of hollow rotating arms of varying lengths located peripherally of said rotating conical flow controlling member and forming said stream into a plurality of rotating smaller finely divided steams which are radially dispersed relative to the axially flow direction of said first stream, and which form a shower of said particulate material dispersed in a substantially uniform flow of said particulate material over a given area downstream of said supply thereof whereby a substantially uniform coating is provided on said article.

2. A method as defined in claim 1 wherein said article to be coated is a wax pattern.

3. A distribution system suitable for coating articles such as wax patterns, placed in a given area with a particulate material, in a substantially uniform manner, comprising retaining means for retaining a supply of particulate material, distribution means comprising a plurality of arms, each having an inlet opening and a discharge opening, said arms being of varying length, and being mounted for rotation about a central axis, rotatable means for dividing and feeding a supply of particulate material from said retaining means into said inlet openings of said arms, said means for dividing and feeding said supply of particulate material comprising a conical member moveable between opened and closed relationship with said means for retaining the supply of particulate material, the inlet opening of said arms being located about said rotatable means, the discharge opening of said arms being located on each of the arms in such a manner so as to permit discharge of the particulate material from each arm over said given area, whereby when the arms rotate in conjunction with the dividing and feeding means, a supply of particulate material is divided and fed into the inlet openings of the arms and is discharged through the discharge opening, thereby providing a substantially uniform shower of the particulate material over said given area.

4. A distribution system as claimed in claim 3 further including a deflector arm adjacent said dividing and feeding means for diverting particulate material toward the central core of said given area.

5. A distribution system as claimed in claim 3 wherein said arms include baffle plates extending below said discharge openings to deflect particulate material passing through said discharge openings.

6. A distribution system as claimed in claim 3 wherein said arms are mounted with their inlet openings adjacent said conical member, said conical member being movable between said open and closed relationship by means of a shaft extending through and associated with said conical member, whereby lowering of said shaft allows passage of particulate material from said supply thereof over the surface of said conical member and into said arms.

7. An apparatus as defined in claim 3 wherein said distribution means comprises a conical member having a plurality of arms extending therefrom, said arms being of varying lengths and each being provided with at least one aperture on the underside thereof to permit the discharge of said particulate matter therefrom, said conical member and plurality of arms being controlled by movement of a shaft extending through said retaining means and being connected to said distribution means, whereby rotation of said shaft effects rotation of said distribution means.

8. An apparatus as defined in claim 3 further including a curtain assembly surrounding said given area.

9. An apparatus as claimed in claim 3, further including retaining means detachably associated with said first-mentioned retaining means, the detachably associated retaining means being adapted to receive and retain excess particulate material from said distribution system, and feeding means for feeding the excess particulate material retained by the detachably associated retaining means for feeding the particulate material to said first-mentioned retaining means.

10. An apparatus as defined in claim 9, wherein said feeding means comprise a bucket elevator.

* * * * *